US012130021B2

(12) United States Patent
Park et al.

(10) Patent No.: US 12,130,021 B2
(45) Date of Patent: Oct. 29, 2024

(54) ELECTRIC RANGE AND AIR GUIDE FOR ELECTRIC RANGE

(71) Applicant: LG ELECTRONICS INC., Seoul (KR)

(72) Inventors: Jinwoo Park, Seoul (KR); Junghyeon Cho, Seoul (KR); Seunghak Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 373 days.

(21) Appl. No.: 17/189,448

(22) Filed: Mar. 2, 2021

(65) Prior Publication Data

US 2021/0285656 A1 Sep. 16, 2021

(30) Foreign Application Priority Data

Mar. 12, 2020 (KR) ..... 10-2020-0030923

(51) Int. Cl.
*F24C 15/10* (2006.01)

(52) U.S. Cl.
CPC ..... *F24C 15/101* (2013.01); *F24C 15/102* (2013.01)

(58) Field of Classification Search
CPC .. G05B 23/0275; F24C 15/101; F24C 15/102; H01L 2224/78; H01L 2224/7801; H01L 2224/85; H01L 2224/85909; H01L 24/78; H01L 2924/00014; H05B 6/1263
USPC ..... 219/623
See application file for complete search history.

(56) References Cited

U.S. PATENT DOCUMENTS

| | | | | |
|---|---|---|---|---|
| 10,980,156 | B2 * | 4/2021 | Kim | H05K 7/207 |
| 2007/0278215 | A1 | 12/2007 | Schilling | |
| 2008/0142512 | A1 * | 6/2008 | Kim | F24C 15/101 219/757 |
| 2008/0185376 | A1 | 8/2008 | Gagas | |
| 2010/0163549 | A1 | 7/2010 | Gagas | |
| 2010/0187222 | A1 | 7/2010 | Kim et al. | |
| 2010/0200557 | A1 | 8/2010 | Son | |
| 2012/0152933 | A1 * | 6/2012 | Matsui | H05B 6/1263 219/623 |
| 2012/0305544 | A1 * | 12/2012 | Oagley | H05B 6/1263 219/622 |
| 2014/0014649 | A1 | 1/2014 | Chavan | |
| 2016/0150597 | A1 | 5/2016 | Yun | |
| 2016/0262217 | A1 | 9/2016 | Pastore | |
| 2016/0323937 | A1 | 11/2016 | Anton Falcon et al. | |

(Continued)

FOREIGN PATENT DOCUMENTS

| | | |
|---|---|---|
| DE | 11 201 300 4163 | 5/2015 |
| EP | 1 936 283 | 6/2008 |

(Continued)

OTHER PUBLICATIONS

EP2498574 translation (Year: 2022).*

(Continued)

*Primary Examiner* — Nathaniel E Wiehe
*Assistant Examiner* — Frederick F Calvetti
(74) *Attorney, Agent, or Firm* — KED & ASSOCIATES, LLP

(57) ABSTRACT

An electric range is provided that may include an air guide provided with a first member that prevents air, output from an air blowing fan, from flowing into a space between a lower surface of a case and a drive circuit.

16 Claims, 15 Drawing Sheets

(56) References Cited

U.S. PATENT DOCUMENTS

| | | | | |
|---|---|---|---|---|
| 2017/0019959 | A1 | 1/2017 | Park | |
| 2017/0257913 | A1 | 9/2017 | Vengroff | |
| 2018/0352614 | A1 | 12/2018 | Holzinger et al. | |
| 2019/0101293 | A1* | 4/2019 | Kim | F24C 3/085 |
| 2019/0306931 | A1* | 10/2019 | Malkomes | H05B 6/1263 |
| 2020/0041136 | A1 | 2/2020 | Christensen Phillips | |

FOREIGN PATENT DOCUMENTS

| | | |
|---|---|---|
| EP | 2 498 574 | 9/2012 |
| EP | 2 531 003 | 12/2012 |
| EP | 2 679 913 | 1/2014 |
| EP | 3 177 108 | 6/2017 |
| EP | 3 334 248 | 6/2018 |
| JP | 2007-294474 | 11/2007 |
| KR | 10-2015-0137756 | 12/2015 |
| KR | 10-2017-0133937 | 12/2017 |
| KR | 10-2018-0025011 | 3/2018 |
| KR | 10-2018-0026141 | 3/2018 |
| WO | WO 2008/103009 | 8/2008 |

OTHER PUBLICATIONS

European Search Report issued in Application No. 21162058.8 dated Jul. 23, 2021.

European Search Report dated Aug. 9, 2021 issued in EP Application No. 21162103.2.

* cited by examiner

ELECTRIC RANGE AND AIR GUIDE FOR ELECTRIC RANGE

CROSS-REFERENCE TO RELATED APPLICATION(S)

This application claims priority to and the benefit of Korean Patent Application No. 10-2020-0030923, filed in Korea on Mar. 12, 2020, the disclosure of which is incorporated herein by reference in its entirety.

BACKGROUND

1. Field

An electric range and an air guide for an electric range are disclosed herein.

2. Background

Various types of cooking appliances are used to heat food or other items (hereinafter, collectively "food") at homes or restaurants. The cooking appliances include gas ranges using gas and electric ranges using electricity.

The electric ranges are classified as resistance heating-type electric ranges and induction heating-type electric ranges. In a resistance heating method, electric current is supplied to a metallic resistance wire or a non-metallic heat generation element, such as silicon carbide, to generate heat, and the generated heat is radiated or conducted to heat an object to be heated, for example, a cooking vessel, such as a pot, or a frying pan, for example. In an induction heating method, high-frequency power is supplied to a coil to generate a magnetic field around the coil, and eddy current produced in the generated magnetic field is used to heat an object to be heated made of a metallic material.

Regarding basic theories of induction heating, when electric current is supplied to a working coil or a heating coil, heat is generated while an object to be heated is inductively heated, and the object to be heated is heated by the generated heat.

A related art induction heat cooking apparatus is disclosed in Korean Patent Publication No. 10-2017-0133937, which is hereby incorporated by reference. Also, FIG. 1 is a view showing a shape of a related art induction heating apparatus disclosed in Korean Patent Publication No. 10-2015-0137756, which is hereby incorporated by reference.

Referring to FIG. 1, a support plate 70 is provided with an induction coil 50 in an upper portion thereof and a fan 80 in a lower portion thereof. Air discharged from the fan 80 cools a light emitting member 60 and other electronic components while circulating in a case 10 along a cooling path 90 provided under the support plate 70.

FIG. 2 is a view showing a shape of another related art induction heating apparatus. FIG. 2 is disclosed in Korean Patent Publication No. 10-2018-0025011, which is hereby incorporated by reference.

Referring to FIG. 2, a working coil 82 may be disposed on a middle plate 81, and a third fan 35 may be disposed below the middle plate 81. Air discharged from the third fan 85 cools a heat sink 871 below the middle plate 81 while flowing along a space under the middle plate 81.

In the related art described with reference to FIGS. 1 and 2, air discharged from the fan is delivered in a diffused manner under the plate. Thus, in the related art, air cannot be guided in a concentrated manner to an object to be cooled.

BRIEF DESCRIPTION OF THE DRAWINGS

Embodiments will be described in detail with reference to the following drawings in which like reference numerals refer to like elements, and wherein.

DETAILED DESCRIPTION

Figure 1:
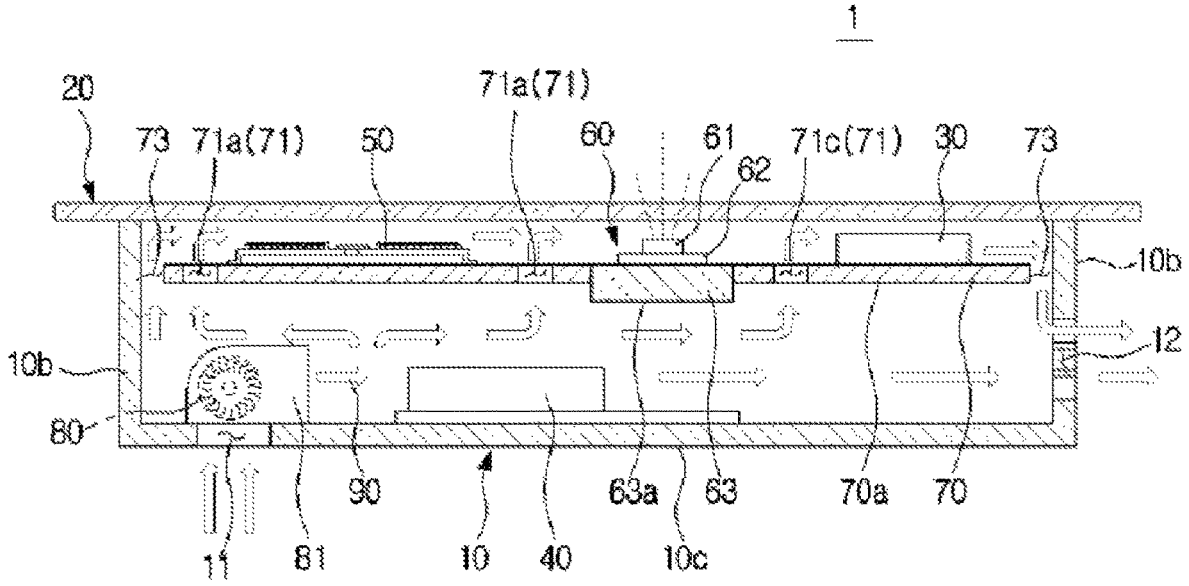
FIG. 1 RELATED ART
FIG. 1 and FIG. 2 are views relating to related art.
Figure 2:
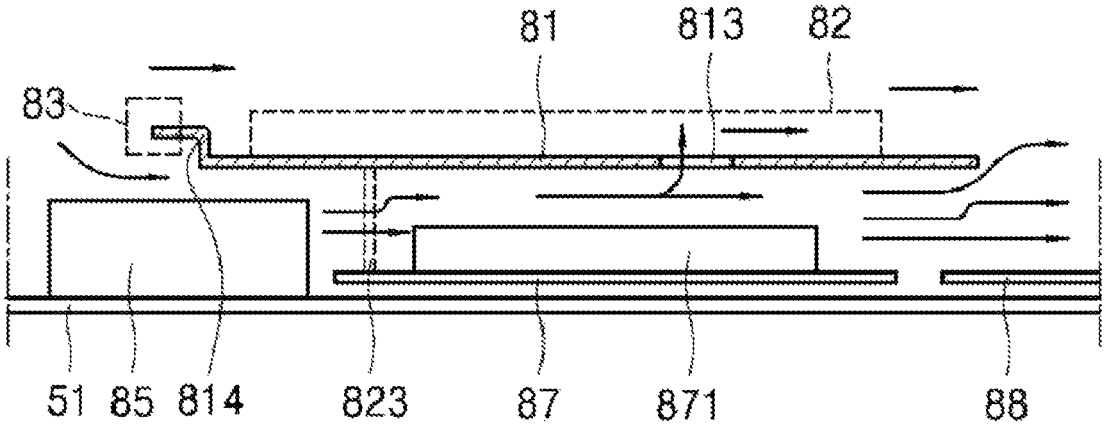
FIG. 2 RELATED ART

Embodiments are described hereinafter with reference to the accompanying drawings such that one having ordinary skill in the art to which embodiments pertain may easily implement the technical idea. In the disclosure, description of known technologies in relation to the disclosure is omitted if it is deemed to make the gist unnecessarily vague. Hereinafter, embodiments are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

When one component is described as being "in an upper portion (or a lower portion)" of another component, or "on (or under)" another component, one component can be placed on the upper surface (or under the lower surface) of another component, and an additional component can be interposed between another component and one component on (or under) another component.

When one component is described as being "connected", "coupled", or "connected" to another component, one component can be directly connected, coupled or connected to another component; however, it is also to be understood that an additional component can be "interposed" between the two components, or the two components can be "connected", "coupled", or "connected" through an additional component.

Hereinafter, each component may be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "have," set forth herein, are not interpreted as necessarily including all the stated components or steps but can be interpreted as including some of the stated components or steps or can be interpreted as further including additional components or steps.

Hereinafter, the terms "A and/or B" as used herein can denote A, B or A and B, and the terms "C to D" can denote C or greater and D or less, unless stated to the contrary.

Hereinafter, an electric range is described with reference to embodiments. The electric range disclosed herein may include an electric resistance-type electric range and an induction heating-type electric range, for example, an induction heating device. For convenience, an induction heating device, provided with a working coil as a heating unit, is described as an example during description of the embodiments. However, embodiments are not limited to those set forth herein.

Figure 3:
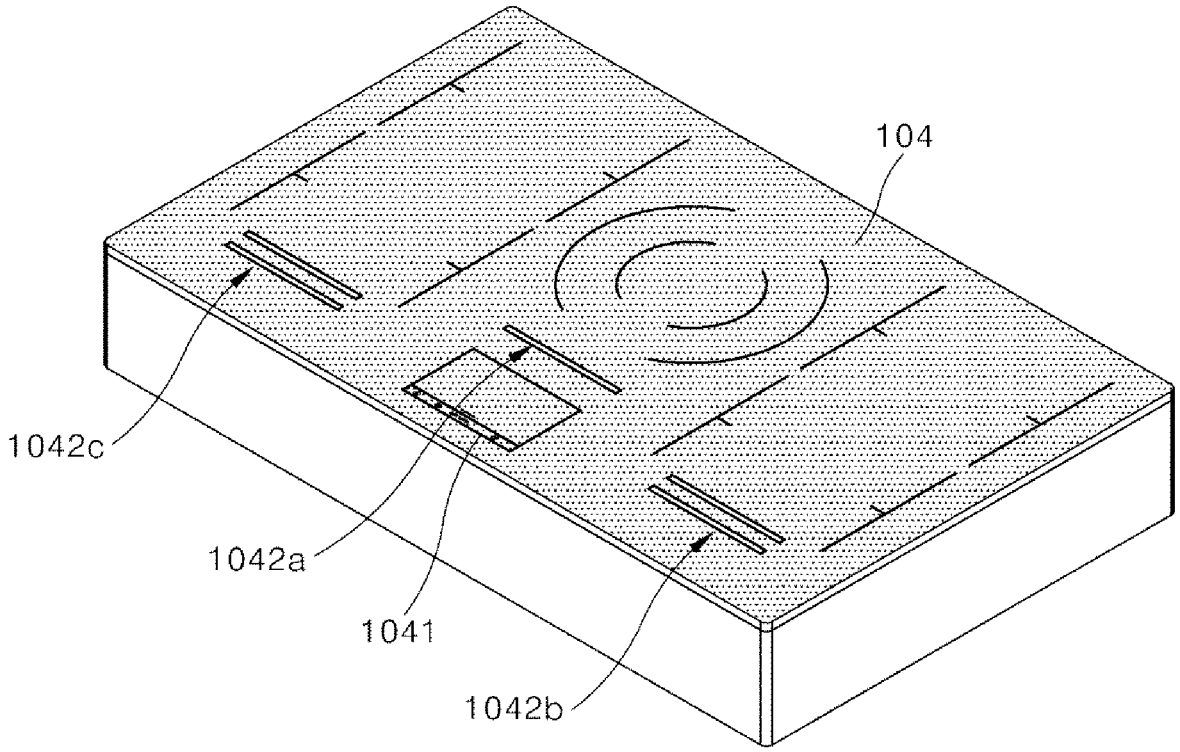
FIG. 3 is a perspective view showing an induction heating device according to an embodiment.

FIG. 3 is a perspective view showing an induction heating device 100 according to an embodiment. FIGS. 4 to 7 are perspective views showing the induction heating device 100 in FIG. 3 without some components.

Figure 4:
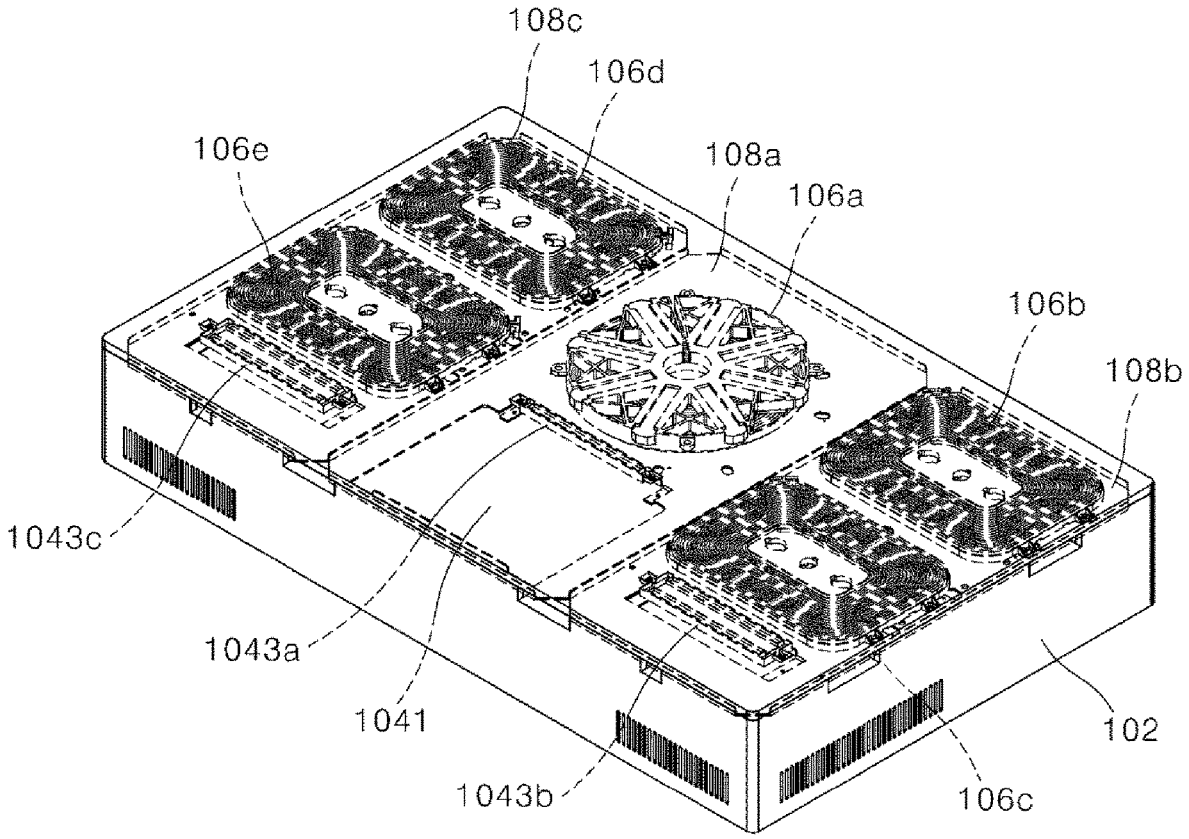
FIGS. 4 to 7 are perspective views showing the induction heating device in FIG. 3 without some components.
Figure 5:
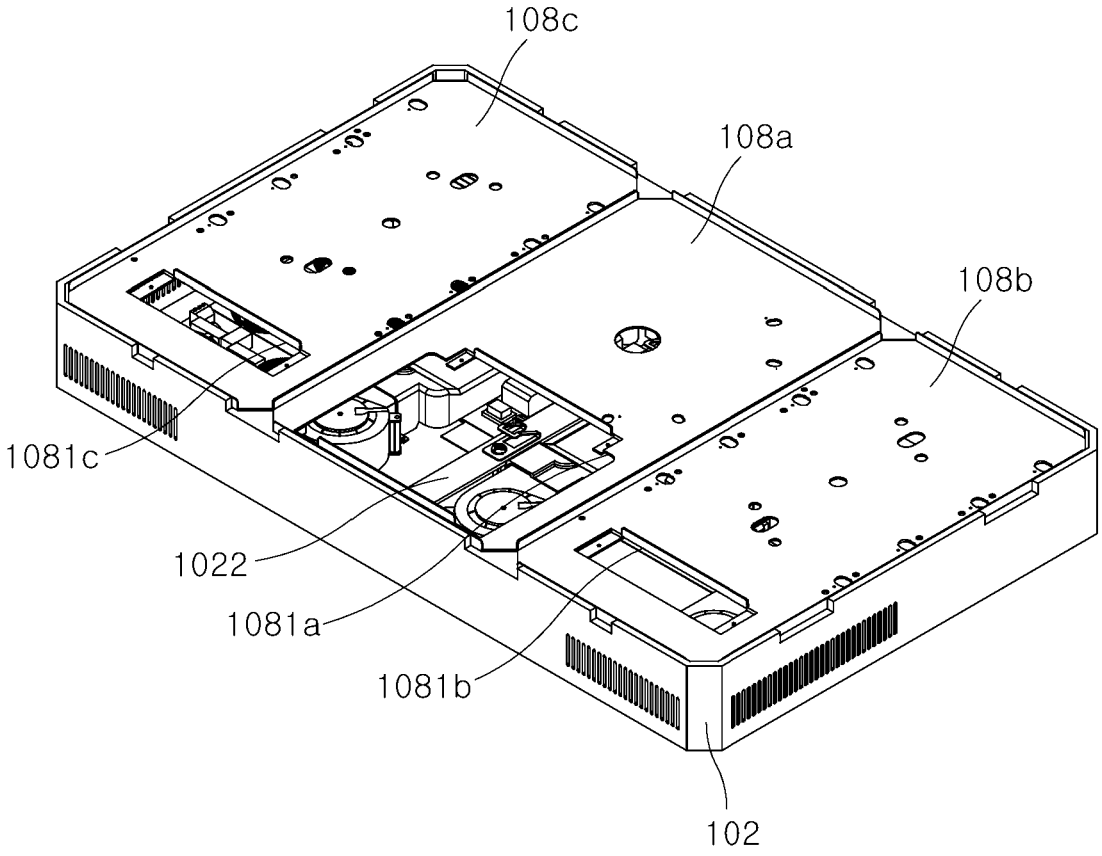
Figure 6:
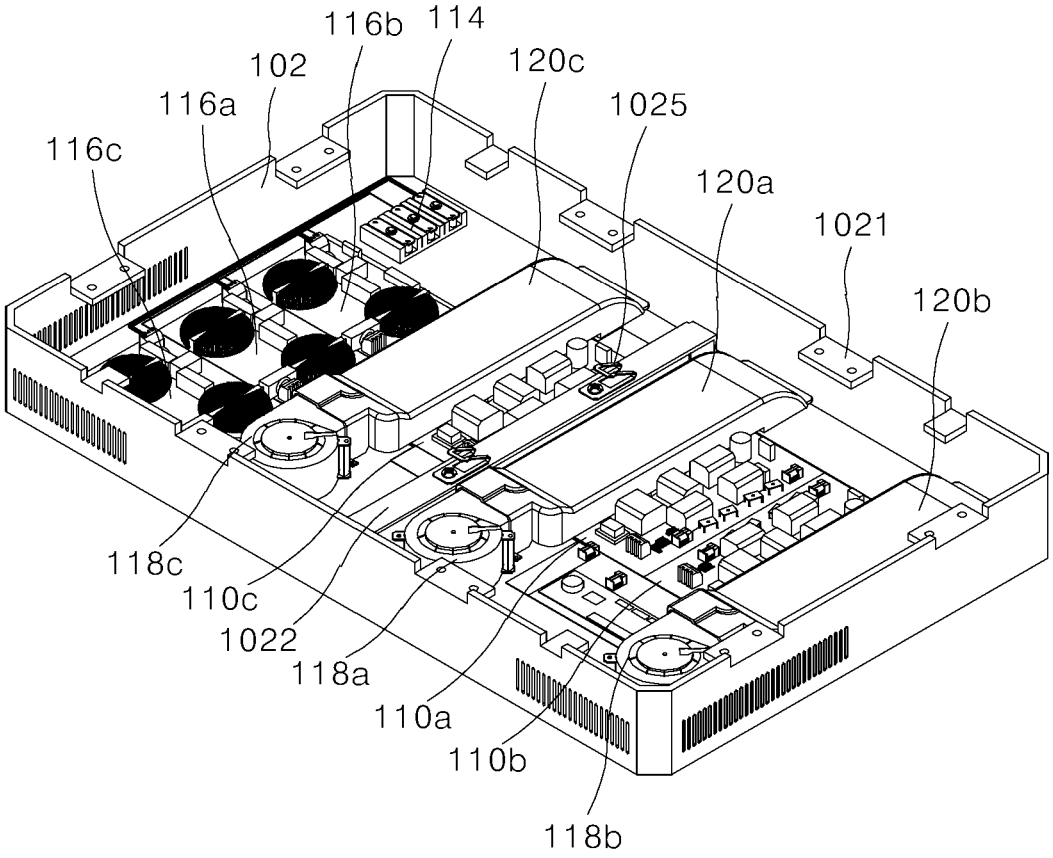
Figure 7:
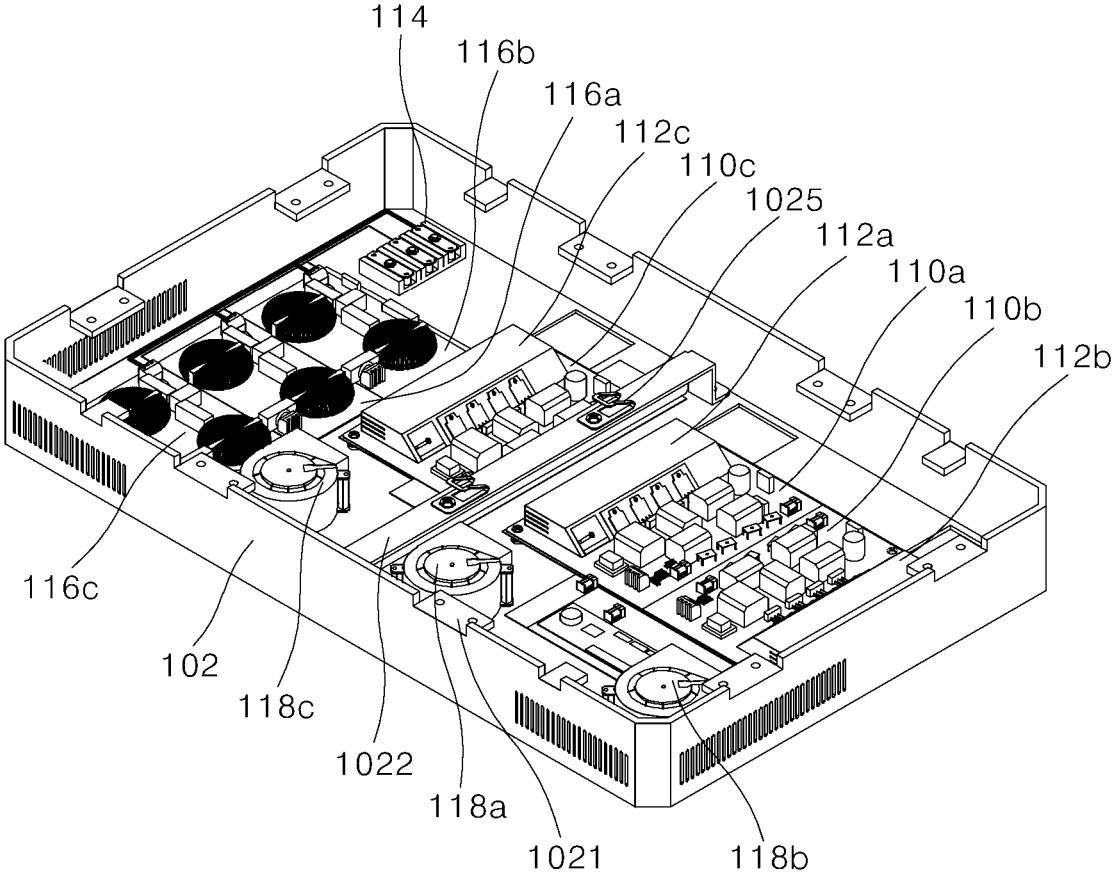

More specifically, FIG. 4 is a view showing the induction heating device 100 in FIG. 3 without a cover plate 104. FIG. 5 is a view showing the induction heating device 100 in FIG. 3 without cover plate 104 and working coils 106*a*, 106*b*, 106*c*, 106*d*, 106*e*. FIG. 6 is a view showing the induction heating device 100 in FIG. 3 without cover plate 104, working coils 106*a*, 106*b*, 106*c*, 106*d*, 106*e*, and base plate 108*a*, 108*b*, 108*c*. FIG. 7 is a view showing the induction heating device 100 in FIG. 3 without cover plate 104, working coil 106*a*, 106*b*, 106*c*, 106*d*, 106*e*, base plate 108*a*, 108*b*, 108*c*, and air guide 120*a*, 120*b*, 120*c*.

Referring to FIGS. 3 to 7, the induction heating device 100 according to an embodiment may include a case 102, cover plate 104, working coils 106*a*, 106*b*, 106*c*, 106*d*, 106*e*, base plate 108*a*, 108*b*, 108*c*, a drive circuit 110*a*, 110*b*, 110*c*, a heat sink 112*a*, 112*b*, 112*c*, a power feeder 114, a filter circuit 116*a*, 116*b*, 116*c*, an air blowing fan (fan) 118*a*, 118*b*, 118*c*, and an air guide 120*a*, 120*b*, 120*c*. The case 102 may protect components in the induction heating device 100. For example, the case 102 may be made of aluminum; however, embodiments are not limited thereto. The case 102 may be thermally insulated to prevent heat, generated by the working coil 106*a*, 106*b*, 106*c*, 106*d*, 106*e*, from leaking outward.

The cover plate 104 may be coupled to an upper end of the case 102 to shield an inside of the case 102, and an object to be heated (not illustrated, an object to be heated by one or more working coils 106*a*, 106*b*, 106*c*, 106*d*, 106*e*) may be placed on an upper surface of the cover plate 104.

An object to be heated, such as a cooking vessel, may be placed on the upper surface of the cover plate 104, and heat generated by the working coil 106*a*, 106*b*, 106*c*, 106*d*, 106*e* may be delivered to the object to be heated through the upper surface of the cover plate 104. The cover plate 104 may be made of glass; however, embodiments are not limited thereto.

An input interface 1041 configured to receive an input from a user may be disposed on the upper surface of the cover plate 104. The input interface 1041 may be recessed into the upper surface of the cover plate 104 and may display a specific image. The input interface 1041 may receive a touch input from the user, and the induction heating device 100 may be driven based on the received touch input.

More specifically, the input interface 1041 may be a module for inputting a heating intensity or a heating period, for example, desired by the user, and may be implemented as a physical button or a touch panel, for example. Additionally, the input interface 1041 may display a drive state of the induction heating device 100. For example, the input interface 1041 may be a thin film transistor liquid crystal display (TFT LCD); however, embodiments are not limited thereto.

Light display areas 1042*a*, 1042*b*, 1042*c* may be formed on the upper surface of the cover plate 104. Light source units (lighting units) 1043*a*, 1043*b*, 1043*c* may be disposed below the cover plate 104, and light emitted from the light source units 1043*a*, 1043*b*, 1043*c* may be delivered to the user through the light display areas 1042*a*, 1042*b*, 1042*c*.

The working coil 106*a*, 106*b*, 106*c*, 106*d*, 106*e* may be a heating unit that heats an object to the heated, and may be disposed in the case 102. The working coil 106*a*, 106*b*, 106*c*, 106*d*, 106*e* may include a wire wound multiple times in a ring shape, and may generate an alternating current (AC) magnetic field. Additionally, a mica sheet and a ferrite core may be consecutively disposed at a lower side of the working coil 106*a*, 106*b*, 106*c*, 106*d*, 106*e*.

The ferrite core may be fixed to the mica sheet through a sealant, and may diffuse the AC magnetic field generated by the working coil 106*a*, 106*b*, 106*c*, 106*d*, 106*e*. The mica sheet may be fixed to the working coil 106*a*, 106*b*, 106*c*, 106*d*, 106*e* and the ferrite core through a sealant, and may prevent direct delivery of the heat, generated by the working coil 106*a*, 106*b*, 106*c*, 106*d*, 106*e*, to the ferrite core.

A plurality of working coils 106*a*, 106*b*, 106*c*, 106*d*, 106*e* may be provided. The plurality of working coils 106*a*, 106*b*, 106*c*, 106*d*, 106*e* may include first working coil 106*a* disposed at a central portion of the case 102, second working coil 106*b* and third working coil 106*c* disposed on a right (first) side of the first working coil 106*a*, and a fourth working coil 106*d* and a fifth working coil 106*e* disposed on a left (second) side of the first working coil 106*a*. The second working coil 106*b* and the third working coil 106*c* may be disposed on the right side of the first working coil 106*a* in a frontward-rearward direction, and the fourth working coil 106*d* and the fifth working coil 106*e* may be disposed on the left side of the first working coil 106*a* in the frontward-rearward direction.

For example, the first working coil 106*a* may be a high-output dual heating coil, and the second working coil 106*b*, the third working coil 106*c*, the fourth working coil 106*d*, and the fifth working coil 106*e* may each be a single heating coil. The first working coil 106*a* as a dual heating coil has a heavy weight, and may have a maximum output of 7000 kW.

The induction heating device 100 according to an embodiment may perform the function of wireless power transmission based on configurations and features described above. Technologies for wirelessly supplying power have been developed and have been used for a wide range of electronic devices. A battery of an electronic device, to which the wireless power transmitting technology is applied, can be charged only by being placed on a charge pad without connecting to an additional charge connector. Accordingly, the electronic device, to which the wireless power transmitting technology is applied, requires no cord or no charger, thereby ensuring improved mobility and a reduced size and weight.

The wireless power transmitting technology can be broadly classified as an electromagnetic induction technology using a coil, a resonance technology using resonance, and a radio emission technology for converting electric energy into microwaves and delivering the microwaves, for example. In the electromagnetic induction technology, power is transmitted using electromagnetic induction between a primary coil, that is, a working coil, included in an apparatus for wirelessly transmitting power and a secondary coil included in an apparatus for wirelessly receiving power.

The theory of the induction heating technology of the induction heating device 100 is substantially the same as that of the electromagnetic induction-based wireless power transmission technology, in that an object to be heated is heated using electromagnetic induction. Accordingly, the induction heating device 100 according to an embodiment may perform the function of wireless power transmission, as well as the function of induction heating.

The base plate 108*a*, 108*b*, 108*c* may be disposed at an end of the case 102, and the plurality of working coils 106*a*, 106*b*, 106*c*, 106*d*, 106*e* may be disposed in an upper portion of the base plate 108*a*, 108*b*, 108*c*. The base plate 108*a*, 108*b*, 108*c* may support the plurality of working coils 106*a*, 106*b*, 106*c*, 106*d*, 106*e* which are heavy, and may help the plurality of working coils 106*a*, 106*b*, 106*c*, 106*d*, 106*e* to be mounted. The input interface 1041 and the light source units 1043*a*, 1043*b*, 1043*c* may be further disposed at the upper portion of the base plate 108*a*, 108*b*, 108*c*.

According to one embodiment, a plurality of base plates 108*a*, 108*b*, 108*c* may be provided; however, embodiments are not limited thereto. Alternatively, a single base plate may be disposed in the case 102.

The plurality of base plates 108*a*, 108*b*, 108*c* may include first base plate 108*a*, second base plate 108*b*, and third base plate 108*c*. The first base plate 108*a*, the second base plate 108*b*, and the third base plate 108*c* may be disposed at the end of the case 102 side by side with each other.

The first base plate 108*a* may be disposed at a central portion of the end of the case 102. The first working coil 106*a* may be disposed at an upper portion of the first base plate 108*a*.

The input interface 1041, and first light source unit 1043*a* corresponding to the first working coil 106*a* may be further disposed in the upper portion of the first base plate 108*a*. The first base plate 108*a* may have a through hole 1081*a* for installing the input interface 1041 and the first light source unit 1043*a*.

The second base plate 108*b* may be disposed on a right (first) side of the first base plate 108*a* at the end of the case 102. The second working coil 106*b* and the third working coil 106*c* may be disposed at an upper portion of the second base plate 108*b*.

A second light source unit 1043*b* corresponding to the second working coil 106*b* and the third working coil 106*c* may be further disposed in the upper portion of the second base plate 108*b*. In the upper portion of the second base plate 108*b*, the second working coil 106*b*, the third working coil 106*c*, and the second light source unit 1043*b* may be consecutively disposed. The second base plate 108*b* may have a through hole 1081*b* for installing the second light source unit 1043*b*.

The third base plate 108*c* may be disposed on a left (second) side of the first base plate 108*a* at the end of the case 102. The fourth working coil 106*d* and the fifth working coil 106*e* may be disposed at an upper portion of the third base plate 108*c*.

A third light source unit 1043*c* corresponding to the fourth working coil 106*d* and the fifth working coil 106*e* may be further disposed at the upper portion of the third base plate 108*c*. In the upper portion of the third base plate 108*c*, the fourth working coil 106*d*, the fifth working coil 106*e*, and the third light source unit 1043*c* may be consecutively disposed. The third base plate 108*c* may have a through hole 1081*c* for installing the third light source unit 1043*c*.

The case 102 may have a plurality of mounting portions 1021 to mount the plurality of base plates 108*a*, 108*b*, 108*c* at an outer circumferential surface of the case 102. That is, edges of the plurality of base plates 108*a*, 108*b*, 108*c* may be mounted onto a top of the plurality of mounting portions 1021. Accordingly, the plurality of base plates 108*a*, 108*b*, 108*c* may be disposed at the end of the case 102.

The case 102 may include a bracket 1022 at a central portion of a lower surface (bottom surface) or of a lower end of the case 102. The bracket 1022 may be disposed at a central portion of a lower side of the first base plate 108*a*, and may prevent a sagging of the lower surface of the first base plate 108*a*, caused by a weight of the first base plate 108*a*. The weight of the first base plate 108*a* may include a weight of the first working coil 106*a* in the upper portion the first base plate 108*a*. The second and third base plate 108*c* and 108*b* located at outer sides of the electric range may be supported by the mounting portions 1021 respectively at two edges facing each other as well as along one edge connecting these two edges. However, the first base plate 108*a* located in or at a center of the electric range, that is, between the second and third base plates 108*b* and 108*c*, may be supported by the mounting portions 1021 at two edges facing each other, while edges connecting the two edges remain unsupported. For this reason, it is advantageous to provide additional support of the first base plate 108*a* by means of the bracket 1022.

The bracket 1022 may include at least one elastic element 1025 on a top of the bracket 1022. For example, the elastic element 1025 may be a leaf spring. An upper end of at least one elastic element 1025 may contact the lower surface of the first base plate 108*a*, and may prevent a sagging of the lower surface of the first base plate 108*a*.

The drive circuit 110*a*, 110*b*, 110*c* may control driving of the plurality of working coils 106*a*, 106*b*, 106*c*, 106*d*, 106*e* which are heating units, and may further control driving of components, such as an input interface 1041, for example, of the induction heating device 100. The drive circuit 110*a*, 110*b*, 110*c* may include various components in relation to the driving of the working coils 106*a*, 106*b*, 106*c*, 106*d*, 106*e*. The components may include a power supply configured to supply AC power, a rectifier configured to rectify AC power of the power supply into direct current (DC) power, an inverter configured to convert DC power, rectified by the rectifier, into resonance current as a result of a switching operation and supply the resonance current to the working coil 106, a microcomputer, for example, a micom, configured to control the inverter and components in relation to driving of the inverter, and a relay or a semiconductor switch configured to turn on or turn off the working coils 106*a*, 106*b*, 106*c*, 106*d*, 106*e*, for example. Various types of components may be mounted onto a board of the drive circuit 110*a*, 110*b*, 110*c*.

The drive circuit 110*a*, 110*b*, 110*c* may include first drive circuit 110*a*, second drive circuit 110*b*, and third drive circuit 110*c*. The first drive circuit 110*a* may be disposed on a right (first) side of the case 102, for example, on a right (first) side of the lower surface of the case 102, with respect to the bracket 1022 and may control driving of the first working coil 106*a*. The second drive circuit 110*b* may be disposed on the right side of the first drive circuit 110*a* and may control driving of the second working coil 106*b* and the third working coil 106*c*. The third drive circuit 110*c* may be disposed on a left (second) side of the case 102, for example, on a left (second) side of the lower surface of the case 102, with respect to the bracket 1022 and may control driving of the fourth working coil 106*d* and the fifth working coil 106*e*.

The heat sink 112*a*, 112*b*, 112*c* may be disposed over at least a portion of the drive circuit 110*a*, 110*b*, 110*c* and may prevent an increase in temperatures of components disposed at at least a portion of the drive circuit 110*a*, 110*b*, 110*c*.

The heat sink 112*a*, 112*b*, 112*c* may include first heat sink 112*a*, second heat sink 112*b*, and third heat sink 112*c*. The first heat sink 112*a* may prevent an increase in temperatures of components installed in at least a portion of the first drive circuit 110*a*, the second heat sink 112*b* may prevent an increase in temperatures of components installed in at least a portion of the second drive circuit 110*b*, and the third heat sink 112*c* may prevent an increase in temperatures of components installed in at least a portion of the third drive circuit 110*c*.

The power feeder 114 may supply an external power source to the induction heating device 100. The power feeder 114 may be implemented as a terminal block, for example.

The power feeder 114 may be disposed at any one of edges of the case 102, for example, at the rear end of the case 102 or on the lower surface of the case 102. For example, the power feeder 114 may be disposed at a rear end of the left side of the lower surface of the case 102.

The filter circuit 116*a*, 116*b*, 116*c* may be disposed at any one of the edges of the lower end of the case 102, and may reduce noise made by the plurality of working coils 106*a*, 106*b*, 106*c*, 106*d*, 106*e*. The filter circuit 116*a*, 116*b*, 116*c* may include first filter circuit 116*a*, second filter circuit 116*b*, and third filter circuit 116*c*.

The first filter circuit 116*a* may reduce noise made by the first working coil 106*a*. The second filter circuit 116*b* may reduce noise made by the second working coil 106*b* and the third working coil 106*c*. The third filter circuit 116*c* may reduce noise made by the fourth working coil 106*d* and the fifth working coil 106*e*.

The air blowing fan 118*a*, 118*b*, 118*c* may reduce a temperature inside of the case 102. Accordingly, the air blowing fan 118*a*, 118*b*, 118*c* may lower a temperature of various components installed in the drive circuits 110*a*, 110*b*, 110*c*.

The air blowing fan 118*a*, 118*b*, 118*c* may be disposed below or on the lower side of the working coils 106*a*, 106*b*, 106*c*, 106*d*, 106*e*. The air blowing fan 118*a*, 118*b*, 118*c* may be disposed on the lower surface of the case 102, for example, on a front side or edge thereof.

The air blowing fan 118*a*, 118*b*, 118*c* may reduce a temperature inside of the case 102. Accordingly, the air blowing fan 118*a*, 118*b*, 118*c* may lower a temperature of various components installed in or on the drive circuits 110*a*, 110*b*, 110*c*.

The air blowing fan 118*a*, 118*b*, 118*c* may include first air blowing fan 118*a*, second air blowing fan 118*b*, and third blow fan 118*c*. The first air blowing fan 118*a* may cool various components installed in or on the first drive circuit 110*a* and may further cool the first light source unit 1043*a* and the input interface 1041. More particularly, the first air blowing fan 118*a* may deliver air (wind) for cooking to the first heat sink 112*a* in or at an upper portion of the first drive circuit 110*a*.

The second air blowing fan 118*b* may cool various components installed in or on the second drive circuit 110*b* and may further cool the second light source unit 1043*b*. More particularly, the second air blowing fan 118*b* may deliver air for cooling to the second heat sink 112*b* in or at an upper portion of the second drive circuit 110*b*.

The third air blowing fan 118*c* may cool various components installed in or on the third drive circuit 110*c* and may further cool the third light source unit 1043*c*. More particularly, the third air blowing fan 118*c* may deliver air for cooling to the third heat sink 112*c* in or at an upper portion of the third drive circuit 110*c*.

The air blowing fans 118*a*, 118*b*, 118*c* may not include structure for preventing a foreign substance from contacting the air blowing fans 118*a*, 118*b*, 118*c*.

The air guide 120*a*, 120*b*, 120*c* may guide air generated by the air blowing fans 118*a*, 118*b*, 118*c*. The light source units 1043*a*, 1043*b*, 1043*c*, the input interface 1041, and the air blowing fans 118*a*, 118*b*, 118*c* may be disposed below or on the lower sides of the working coils 106*a*, 106*b*, 106*c*, 106*d*, 106*e*. The air guide 120*a*, 120*b*, 120*c* may guide air output from the air blowing fan 118*a*, 118*b*, 118*c*, disposed on the front side of the case 102, toward a rear side of the case 102.

The air guide 120*a*, 120*b*, 120*c* may include first air guide 120*a*, second air guide 120*b*, and third guide 120*c*. The first air guide 120*a* may be disposed to encircle or surround or cover the first heat sink 112*a* installed in at least a portion of the first drive circuit 110*a* and may guide (deliver) air, output from the first air blowing fan 118*a*, to the first heat sink 112*a*. The second air guide 120*b* may be disposed to encircle or surround or cover the second heat sink 112*b* installed in at least a portion of the second drive circuit 110*b* and may guide air, output from the second air blowing fan 118*b*, to the second heat sink 112*b*. The third air guide 120*c* may be disposed to encircle or surround or cover the third heat sink 112*c* installed in at least a portion of the third drive circuit 110*c* and may guide air, output from the third air blowing fan 118*c*, to the third heat sink 112*c*.

The induction heating device 100 according to an embodiment may have configurations and features described above. Hereinafter, a shape of the air guide 120*a*, 120*b*, 120*c* and a configuration for preventing air, output from the air blowing fan 118*a*, 118*b*, 118*c*, from escaping out of the air guide 120*a*, 120*b*, 120*c* are described.

Figure 8:
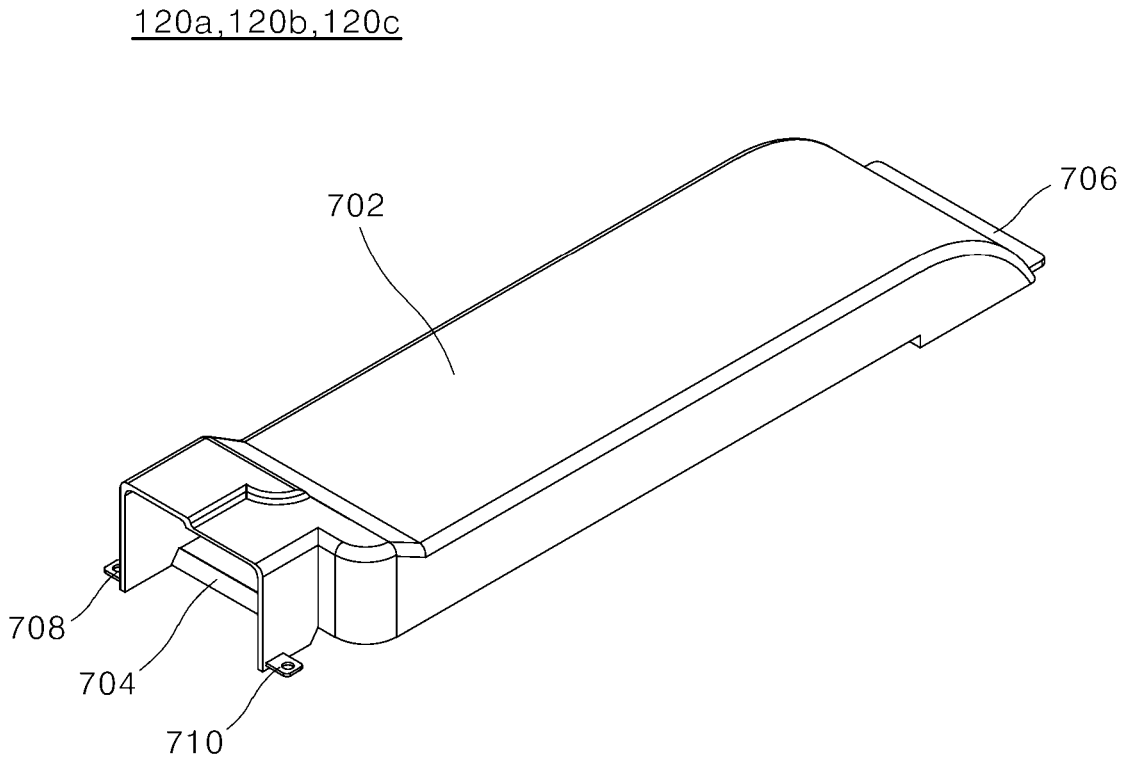
FIG. 8 is a front perspective view showing an air guide according to an embodiment.
Figure 9:
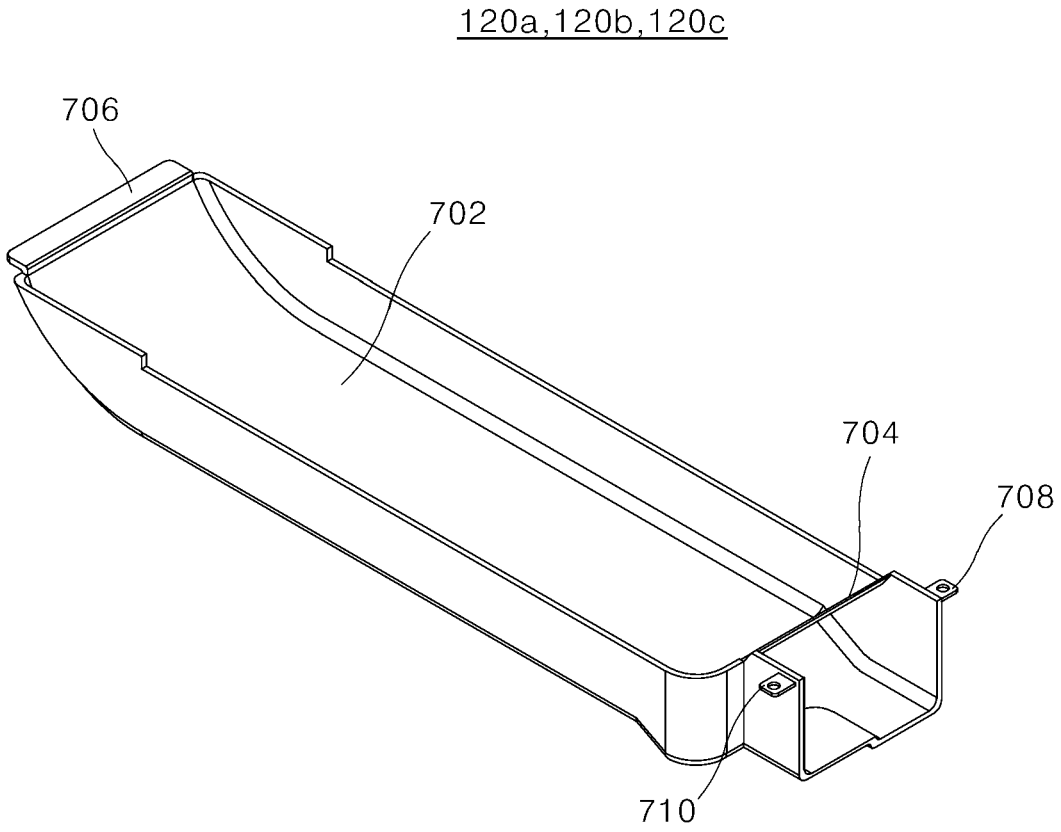
FIG. 9 is a rear perspective view showing an air guide according to an embodiment.
Figure 10:
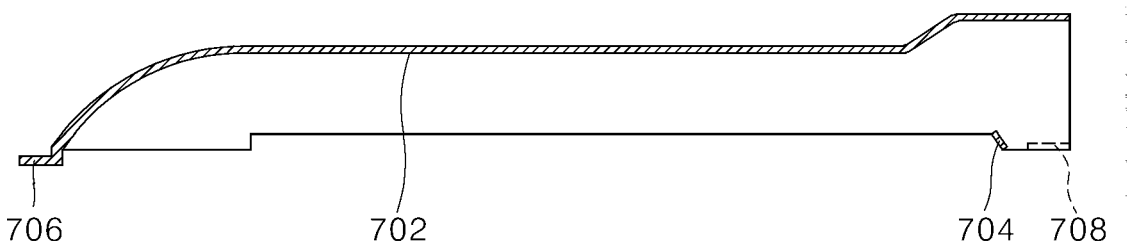
FIG. 10 is a lateral cross-sectional view showing an air guide according to an embodiment.
Figure 11:
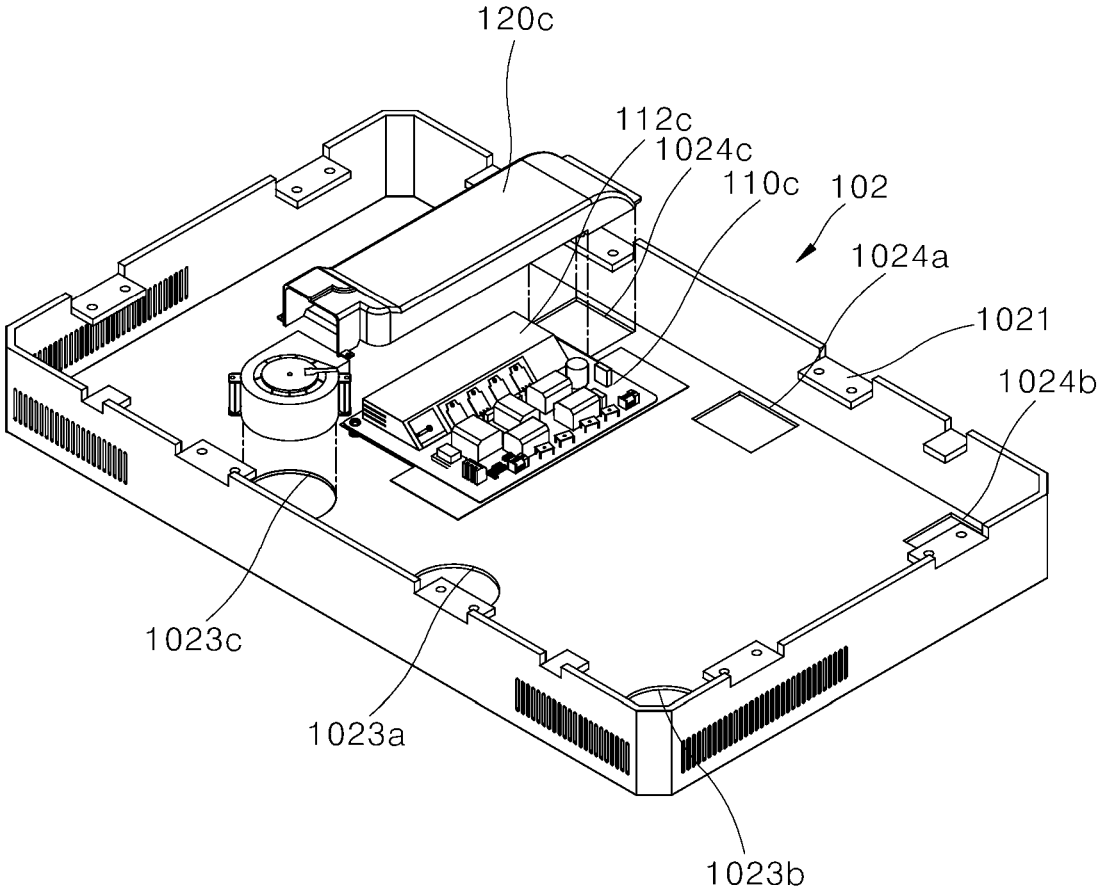
FIG. 11 is a view describing a concept of a shape in which an air blowing fan and an air guide are disposed in a case, according to an embodiment.
Figure 12:
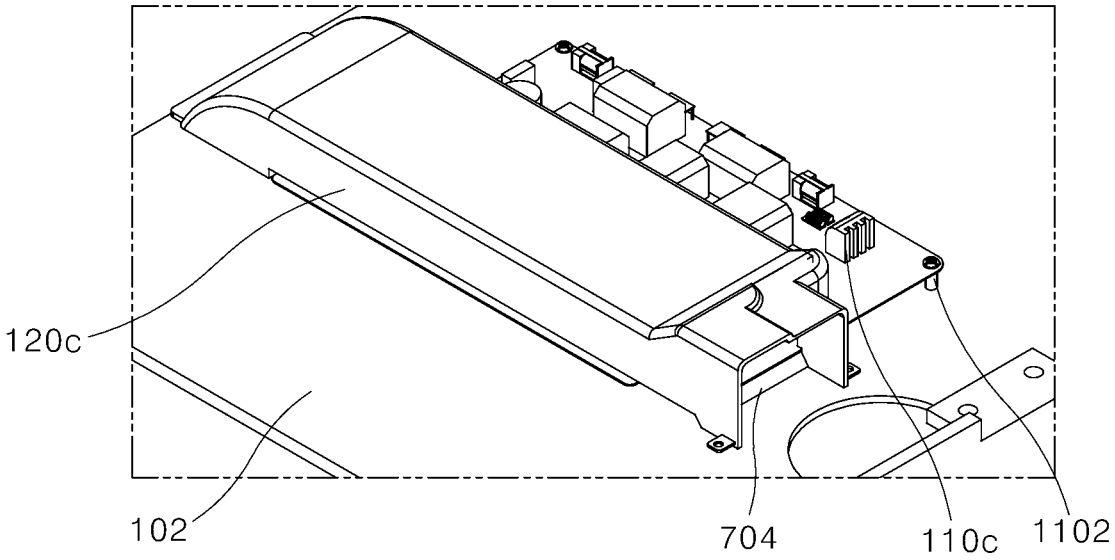
FIG. 12 is a front perspective view showing a drive circuit and an air guide disposed in a case, according to an embodiment.
Figure 13:
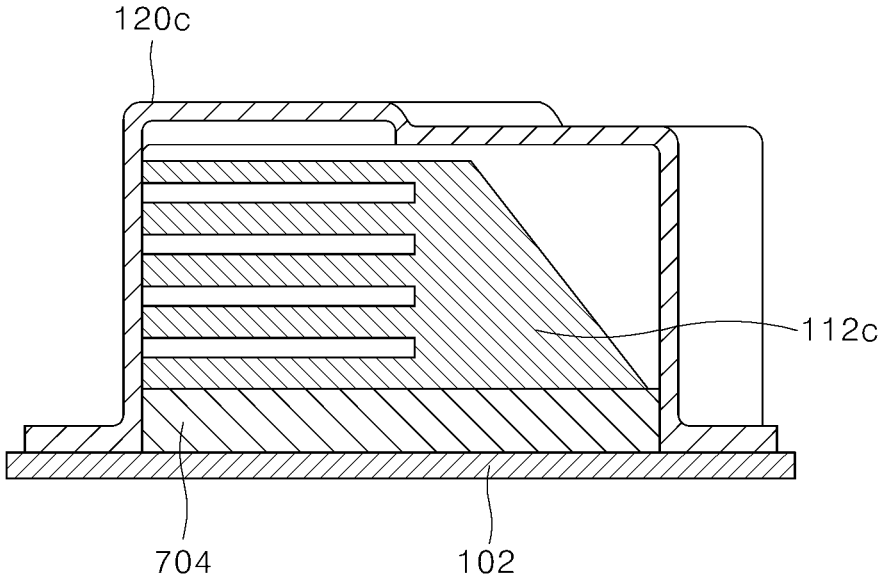
FIG. 13 is a front cross-sectional view showing an air guide disposed in a case, according to an embodiment.
Figure 14:
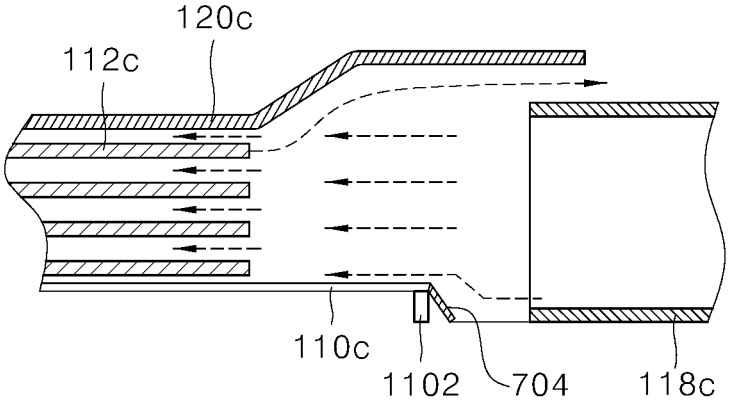
FIG. 14 is a view describing a concept in which air output from an air blowing fan flows into an air guide, according to an embodiment.
Figure 15:
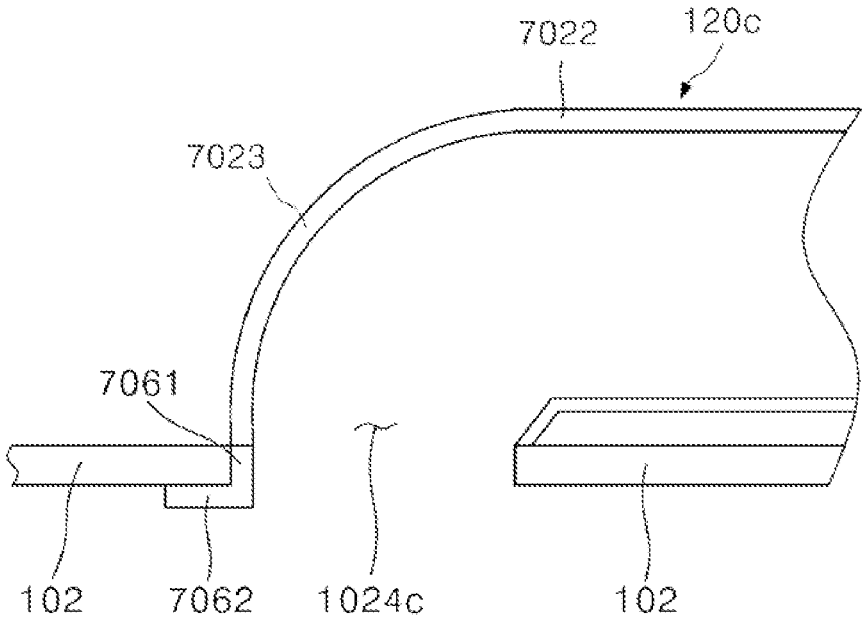
FIG. 15 is a view showing a shape in which an end of an air guide is coupled to a second through hole, according to an embodiment.

FIG. 8 is a front perspective view showing air guide 120*a*, 120*b*, 120*c* according to an embodiment. FIG. 9 is a rear perspective view showing air guide 120*a*, 120*b*, 120*c* according to an embodiment. FIG. 10 is a lateral cross-sectional view showing air guide 120*a*, 120*b*, 120*c* according to an embodiment. FIG. 11 is a view describing a concept of a shape in which air blowing fan 118*a*, 118*b*, 118*c*, and air guide 120*a*, 120*b*, 120*c* are disposed in case 102, according to an embodiment. FIG. 12 is a front perspective view showing drive circuit 110*a*, 110*b*, 110*c* and air guide 120*a*, 120*b*, 120*c* disposed in case 102, according to an embodiment. FIG. 13 is a front cross-sectional view showing air guide 120*a*, 120*b*, 120*c* disposed in case 102, according to an embodiment. FIG. 14 is a view describing a concept in which air output from air blowing fan 118*a*, 118*b*, 118*c* flows into air guide 120*a*, 120*b*, 120*c*, according to an embodiment. FIG. 15 is a view showing a shape in which the other end of air guide 120*a*, 120*b*, 120*c* is coupled to a second through hole 1024*a*, 1024*b*, 1024*c*, according to an embodiment. For convenience of description, FIGS. 11 to 15 show only a way in which the third air guide 120*c* is disposed over the third drive circuit 110*c*, in the case 102.

Referring to FIG. 11, first through hole 1023*a*, 1023*b*, 1023*c* and second through hole 1024*a*, 1024*b*, 1024*c* may be formed at the lower surface of the case 102. The case 102 may have a shape in which the lower surface of the case 102 is closed except for the first through hole 1023*a*, 1023*b*, 1023*c* and the second through hole 1024*a*, 1024*b*, 1024*c*. The first through hole 1023*a*, 1023*b*, 1023*c* and the second through hole 1024*a*, 1024*b*, 1024*c* may be disposed to face each other. Additionally, the drive circuit 110*a*, 110*b*, 110*c* may be disposed between the first through hole 1023*a*, 1023*b*, 1023*c* and the second through hole 1024*a*, 1024*b*, 1024*c*.

The first through hole 1023*a*, 1023*b*, 1023*c* may serve as a passage through which air is supplied to air blowing fan 118*a*, 118*b*, 118*c*. The air blowing fan 118*a*, 118*b*, 118*c* may be disposed in the case 102 in order to suction air through the first through hole 1023*a*, 1023*b*, 1023*c*. That is, the first through hole 1023*a*, 1023*b*, 1023*c* may correspond to an air inlet.

The first through hole 1023*a*, 1023*b*, 1023*c* may be formed on the lower surface or end of the case 102 adjacent to the air blowing fans 118*a*, 118*b*, 118*c*, for example, near lower ends of the air blowing fans 118*a*, 118*b*, 118*c*. Accordingly, air may be supplied to the air blowing fans 118*a*, 118*b*, 118*c*.

The first through hole 1023*a*, 1023*b*, 1023*c* may be formed at an edge of the lower surface of the case 102, for example, at a front edge or side. A number of the first through holes 1023*a*, 1023*b*, 1023*c* may be the same as that of the air blowing fans 118*a*, 118*b*, 118*c*. That is, a (1-1)th through hole 1023*a* may provide a passage through which air is supplied to the first air blowing fan 118*a*, a (1-2)th through hole 1023*b* may provide a passage through which air is supplied to the second air blowing fan 118*b*, and a (1-3)th through hole 1023*c* may provide a passage through which air is supplied to the third air blowing fan 118*c*. The (1-1)th through hole 1023*a*, (1-2)th through hole 1023*b*, and (1-3)th through hole 1023*c* may be disposed side by side at the edge of the lower surface.

The first through hole 1023*a*, 1023*b*, 1023*c* may have a shape corresponding to a shape of a lower surface, or a suction side, of the air blowing fan 118*a*, 118*b*, 118*c*. That is, the shape of the first through hole 1023*a*, 1023*b*, 1023*c* may be the same as a shape of a fan in the air blowing fan 118*a*, 118*b*, 118*c*; however, embodiments are not limited thereto.

The second through hole 1024*a*, 1024*b*, 1024*c* may serve as a passage through which air output from the air blowing fans 118*a*, 118*b*, 118*c* is discharged out of the case 102. That is, the second through hole 1024*a*, 1024*b*, 1024*c* may correspond to an air outlet that discharges air in the case 102 outward.

The air guide 120*a*, 120*b*, 120*c* configured to guide air generated by the air blowing fans 118*a*, 118*b*, 118*c* may be disposed at the lower end of the case 102. One (first) end of the air guide 120*a*, 120*b*, 120*c* may be disposed near or adjacent to the air blowing fan 118*a*, 118*b*, 118*c*. The other (second) end of the air guide 120*a*, 120*b*, 120*c* may contact and connect to the lower surface of the case 102. That is, the other end of the air guide 120*a*, 120*b*, 120*c* may be coupled to the case adjacent to the second through hole 1024*a*, 1024*b*, 1024*c* formed therein.

The second through hole 1024*a*, 1024*b*, 1024*c* may be formed at an edge of the lower surface of the case 102, for example, at a rear edge or side. The second through hole 1024*a*, 1024*b*, 1024*c* may be connected to the other end of the air guide 120*a*, 120*b*, 120*c*, and accordingly, air may be discharged out of the case 102.

A lower portion of the second through hole 1024*a*, 1024*b*, 1024*c* may have a shape corresponding to a shape of the other end of the air guide 120*a*, 120*b*, 120*c*. That is, the shape of the lower portion of the second through hole 1024*a*, 1024*b*, 1024*c* may be the same as that of the other end of the air guide 120*a*, 120*b*, 120*c*.

A number of the second through holes 1024*a*, 1024*b*, 1024*c* may be the same as that of the air guides 120*a*, 120*b*, 120*c*. A (2-1)th through hole 1024*a* may connect to the first air guide 120*a* and provide a passage through which air is discharged, a (2-2)th through hole 1024*b* may connect to the second air guide 120*b* and provide a passage through which air is discharged, and a (2-3)th through hole 1024*c* may connect to the third air guide 120*a* and provide a passage through which air is discharged. The (2-1)th through hole 1024*a*, (2-2)th through hole 1024*b* and (2-3)th through hole 1024*c* may be disposed side by side at the edge of the upper side of the case 102.

Referring to FIG. 5 and FIGS. 8 to 10, the air guide 120*a*, 120*b*, 120*c* may include a housing 702, a first member 704, a first connecting portion 706, a second connecting portion 708, and a third connecting portion 710. The air guide 120*a*, 120*b*, 120*c* may be integrally formed through single processing.

The housing 702 may form a body of the air guide 120*a*, 120*b*, 120*c*. The housing 702 may be hollow inside. Additionally, the housing 702 may be made of a plastic material; however, embodiments not limited thereto.

The housing 702 may have one (first) end, a middle end, and the other (second) end. The one end of the housing 702 may be disposed adjacent to or near the air blowing fan 118*a*, 118*b*, 118*c*. Air output from the air blowing fan 118*a*, 118*b*, 118*c* may be supplied to the one end of the housing 702. For example, a portion of the one end of the housing 702 may be disposed to overlap a portion of an output end of the air blowing fan 118*a*, 118*b*, 118*c*.

Referring to FIG. 10, the one end of the housing 702 may have a rectangular shape in the lateral cross-sectional view. A height of at least a portion of an upper surface of the one end of the housing 702 may be greater than a height of the air blowing fan 118*a*, 118*b*, 118*c*.

More specifically, the upper surface of the one end of the housing 702 may include a first portion and a second portion. The first portion and the second portion of the one end of the housing 702 may be connected to each other. For example, the first portion of the one end of the housing 702 may be a right portion of the upper surface of the one end of the housing 702, and the second portion of the one end of the housing 702 may be a left portion of the upper surface of the one end of the housing 702.

The first portion (the right portion) of the one end of the housing 702 may be disposed in contact with an upper surface of the air blowing fan 118*a*, 118*b*, 118*c*. That is, the first portion of the one end of the housing 702 may be mounted onto the upper surface of the air blowing fan 118*a*, 118*b*, 118*c*.

A height of the second portion (the left portion) of the one end of the housing 702 may be greater than a height of the upper surface of the air blowing fan 118*a*, 118*b*, 118*c*. In this case, a gap may be formed between the second portion of the one end of the housing 702 and the upper surface of the air blowing fan 118*a*, 118*b*, 118*c*. Through the gap, some of the air output from the air blowing fan 118*a*, 118*b*, 118*c* may be discharged. The discharged air may be delivered to the light source unit 1043*a*, 1043*b*, 1043*c* and the input interface 1041, and based on the discharged air, the light source unit 1043*a*, 1043*b*, 1043*c* and the input interface 1041 may be cooled.

The first member 704 may be formed on a lower side of the one end of the housing 702. The first member 704 may be disposed between the air blowing fan 118*a*, 118*b*, 118*c* and the drive circuit 110*a*, 110*b*, 110*c*. One (first) end of the first member 704 may be disposed to contact the lower surface of the case 102, and the other (second) end of the first member 704 may be disposed to contact an end of the drive circuit 110*a*, 110*b*, 110*c*, at which the air blowing fan 118*a*, 118*b*, 118*c* is disposed. A left end of the first member 704 may be connected to a left surface of the one end of the air guide 120*a*, 120*b*, 120*c*, and a right end of the first member 704 may be connected to a right surface of the one end of the air guide 120*a*, 120*b*, 120*c*.

The first member 704 may prevent the air, output from the air blowing fan 118*a*, 118*b*, 118*c*, from flowing into a space between the lower surface of the case 102 and the drive circuit 110*a*, 110*b*, 110*c*. The first member 704 may be formed at a slant. In this case, a height of the first member 704 formed at a slant may correspond to a first distance between the air blowing fan 118*a*, 118*b*, 118*c* and the drive circuit 110*a*, 110*b*, 110*c*. Accordingly, the air output from the air blowing fan 118*a*, 118*b*, 118*c* may be guided to the drive circuit 118*a*, 118*b*, 118*c* in a concentrated manner. The first member is described hereinafter.

The middle end of the housing 702 may be disposed in a way that encircles at least a portion of the drive circuit 118*a*, 118*b*, 118*c*. That is, the heat sink 112*a*, 112*b*, 112*c* may be disposed over at least a portion of the drive circuit 118*a*, 118*b*, 118*c*, and may be disposed inside of the middle end of the housing 702. Both sides of the middle end of the housing 702 may be disposed in contact with an upper surface of the drive circuit 118*a*, 118*b*, 118*c*, for example, an upper surface of a board of the drive circuit 118*a*, 118*b*, 118*c*. More particularly, air may be prevented from leaking outward from between a middle end of the air guide 120*a*, 120*b*, 120*c* and the upper surface of the board. Accordingly, based on air flowing to the middle end of the housing 702, the heat sink 112*a*, 112*b*, 112*c* may be efficiently cooled.

Referring to FIG. 10, a first portion at one end of the middle end of the housing 702 may have a pentagonal shape, and the remaining portion of the middle end of the housing 702 may have rectangular shape, in the lateral cross-sectional view. One end of the first portion of the middle end of the housing 702 may connect to one end of the housing 702, and the other end of the first portion of the middle end of the housing 702 may connect to the remaining portion of the middle end of the housing 702.

The other end of the housing 702 may be disposed in contact with the lower surface of the case 102. That is, the other end of the housing 702 may connect to the second through hole 1024*a*, 1024*b*, 1024*c*. Air, output from the air blowing fan 118*a*, 118*b*, 118*c* and passing through at least a portion of the drive circuit 118*a*, 118*b*, 118*c*, may be output from the other end of the housing 702.

Referring to FIG. 15, the middle end 7022 of the housing 702 may have a flat shape, and the other end 7023 of the housing 702 connected to the middle end 7022 of the housing 702 may have a curved shape, in the lateral cross-sectional view. For example, the other end 7023 of the housing 702 may have a circular sector shape having a central angle of 90°. As the other end 7023 of the housing 702 has a curved shape, air in the housing 702 may be smoothly discharged through the second through hole 1024*a*, 1024*b*, 1024*c*. More particularly, the housing 702 may have the first connecting portion 706 for connection with the lower surface of the case 102, for example, the second through hole 1024*a*, 1024*b*, 1024*c*, at the other end thereof.

Referring to FIG. 15, the first connecting portion 706 may include an extended portion 7061 that extends downward from the other end of the air guide 120*a*, 120*b*, 120*c*, and a bent portion 7062 bent at the extended portion 7061. The other end of the second through hole 1024*a*, 1024*b*, 1024*c* and the air guide 120*a*, 120*b*, 120*c* may have a square shape. The extended portion 7061 and the bent portion 7062 may also have a square shape. However, the extended portion 7061 and the bent portion 7062 may have different shapes other than the square shape.

The extended portion 7061 may be disposed to face (in contact with) an upper edge of the second through hole 1024*a*, 1024*b*, 1024*c*, and the bent portion 7062 may be disposed under the lower surface of the case 102 adjacent to the upper edge of the second through hole 1024*a*, 1024*b*, 1024*c*. The first connecting portion 706 may be fitted to an outside of the second through hole 1024*a*, 1024*b*, 1024*c* by an external force applied by a user. Accordingly, the first connecting portion 706 may protrude outward.

That is, the first connecting portion 706 may protrude to an outside of the second through hole 1024*a*, 1024*b*, 1024*c* such that the second through hole 1024*a*, 1024*b*, 1024*c* and the other end of the housing 702 connect. Accordingly, the other end of the housing 702 may be easily connected to the second through hole 1024*a*, 1024*b*, 1024*c* without means, such as a screw-coupling, for example.

The first connecting portion 706 is described hereinafter.

The housing 702 may have the second connecting portion 708 and the third connecting portion 710, at one end thereof. The second connecting portion 708 and the third connecting portion 710 may be formed on both sides of one end of the housing 702 and may have a coupling hole for coupling the housing 702 to the lower surface of the case 102. For example, the second connecting portion 708 and the third connecting portion 710 may be screw-coupled to the lower surface of the case 102.

Hereinafter, effects of a structure of the air guide 120*a*, 120*b*, 120*c* are described with reference to FIGS. 12 to 15. For convenience of description, FIGS. 12 to 15 show only the third air guide 120*c* and the third drive circuit 110*c*.

The drive circuit 110*a*, 110*b*, 110*c* may be spaced a predetermined first distance apart from the lower surface of the case 102 for reasons of insulation, for example. That is, the case 102 may have a boss 1102, protruding upward from the lower surface of the case 102, on the lower surface thereof, and the drive circuit 110*a*, 110*b*, 110*c* may be disposed on the boss 1102.

The air blowing fan 118*a*, 118*b*, 118*c* may be disposed in contact with the lower surface of the case 102. In the related art, air output from the air blowing fan 118*a*, 118*b*, 118*c* may flow to a space between the lower surface of the case 102 and the drive circuit 110*a*, 110*b*, 110*c*. The air flowing to the inbetween space may not be delivered to the heat sink 112*a*, 112*b*, 112*c*. Accordingly, cooling efficiency of the heat sink 112*a*, 112*b*, 112*c* may be reduced.

According to embodiments disclosed herein, the first member 704 may be formed at a lower end of the one end of the air guide 120*a*, 120*b*, 120*c*, as illustrated in FIGS. 12 to 14. The first member 704 may prevent air, output from the air blowing fan 118*a*, 118*b*, 118*c*, from flowing into the space between the lower surface of the case 102 and the drive circuit 110*a*, 110*b*, 110*c*. Accordingly, the air output from the air blowing fan 118*a*, 118*b*, 118*c* may be prevented from escaping out of the air guide 120*a*, 120*b*, 120*c*.

Additionally, the first member 704 may be formed at a slant at the one end of the air guide 120*a*, 120*b*, 120*c*. The inclined shape of the first member 704 may allow the air, output from a lower portion of the air blowing fan 118*a*, 118*b*, 118*c*, to be guided to the drive circuit 110*a*, 110*b*, 110*c* in a concentrated manner.

Based on the first member 704 described above, the induction heating device 100 according to embodiments disclosed herein may improve cooling efficiency of the heat sink 112*a*, 112*b*, 112*c*.

The shape of the first member 704 is not limited to the above shape. That is, the first member 704 may have any shape that may prevent air from flowing into the space between the lower surface of the case 102 and the drive circuit 110*a*, 110*b*, 110*c*.

Further, the middle end of the air guide 120*a*, 120*b*, 120*c* may be disposed in a way that encircles at least a portion of the drive circuit 110*a*, 110*b*, 110*c*. That is, both sides of the middle end of the air guide 120*a*, 120*b*, 120*c* may be disposed in contact with the upper surface of the drive circuit 110*a*, 110*b*, 110*c*. FIG. 12 shows the disposition specifically.

Referring to FIG. 12, both sides of the middle end of the air guide 120*a*, 120*b*, 120*c* may be disposed in contact with the upper surface of the drive circuit 110*a*, 110*b*, 110*c*. Accordingly, air may be prevented from leaking outward from between the middle end of the air guide 120*a*, 120*b*, 120*c* and the upper surface of the drive circuit 110*a*, 110*b*, 110*c*. Thus, pressure of the air guided by the air guide 120*a*, 120*b*, 120*c* may increase, and cooling efficiency of the heat sink 112*a*, 112*b*, 112*c* may improve.

Further, the air guide 120*a*, 120*b*, 120*c* may have the first connecting portion 706 at an end of the other end thereof. The first connecting portion 706 may protrude to the outside of the second through hole 1024*a*, 1024*b*, 1024*c* such that the second through hole 1024*a*, 1024*b*, 1024*c* and the other end of the air guide 120*a*, 120*b*, 120*c* are connected. Based on the first connecting portion 706, the second through hole 1024*a*, 1024*b*, 1024*c* formed on the lower surface of the case 102 and the other end of the air guide 120*a*, 120*b*, 120*c* may be easily connected.

That is, the air guide 120*a*, 120*b*, 120*c* according to an embodiment may be connected to the lower surface of the case 102 through the first connecting portion 706, the second connecting portion 708 and the third connecting portion 710. More particularly, based on the first connecting portion 706, a connection between the air guide 120*a*, 120*b*, 120*c* and the second through hole 1024*a*, 1024*b*, 1024*c* may be simplified.

In summary, the air guide 120*a*, 120*b*, 120*c* may be manufactured through single processing. Thus, manufacturing costs of the air guide 120*a*, 120*b*, 120*c* may be reduced.

Additionally, the air guide 120*a*, 120*b*, 120*c* may include the first member 704 for preventing leakage of air, at one end thereof, and both sides of the middle end of the air guide 120*a*, 120*b*, 120*c* may be disposed in contact with the upper surface of the drive circuit 110*a*, 110*b*, 110*c*. Thus, air for cooling the heat sink 112*a*, 112*b*, 112*c* may be prevented from leaking outward, and cooling efficiency of the heat sink 112*a*, 112*b*, 112*c* may be improved. More particularly, the first member 704 may be disposed at a slant such that air is delivered to the heat sink 112*a*, 112*b*, 112*c* in a concentrated manner.

Further, the first connecting portion 706 may be formed at the end of the other end of the air guide 120*a*, 120*b*, 120*c*, and based on the first connecting portion 706, the second through hole 1024*a*, 1024*b*, 1024*c*, formed on the lower surface of the case 102, and the other end of the air guide 120*a*, 120*b*, 120*c* may be connected. Thus, air in the air guide 120*a*, 120*b*, 120*c* may be effectively discharged out of the case, and the other end of the air guide 120*a*, 120*b*, 120*c* may be easily connected to the second through hole 1024*a*, 1024*b*, 1024*c*.

Embodiments disclosed herein provide an electric range that may prevent air, output from an air blowing fan, from escaping out of an air guide. Embodiments disclosed herein further provide an electric range that may guide air, output from an air blowing fan, to deliver the air to an object to be cooled in a concentrated manner. Embodiments disclosed herein furthermore provide an electric range that may help to improve cooling efficiency of a heat sink.

Embodiments disclosed herein provide an electric range in which an air guide may be manufactured through single processing, thereby ensuring a reduction in manufacturing costs of the air guide. Embodiments disclosed herein also provide an electric range in which an air guide may be easily coupled to a case.

Advantages are not limited to the described ones, and other advantages that are not mentioned may be clearly understood from the description and may be more clearly understood from embodiments set forth herein.

Embodiments disclosed herein provide an air guide for an electric range that may include a first member that prevents air, output from an air blowing fan, from flowing into a space between a lower surface of a case and a drive circuit, thereby blocking the air from escaping out of the air guide and helping to improve cooling efficiency of a heat sink as an object to be cooled. The first member may be disposed at a slant, thereby delivering air to the heat sink in a concentrated manner.

The air guide may be disposed in a way that encircles at least a portion of the drive circuit, thereby preventing air from escaping from between the air guide and the drive circuit. An end of the air guide may be disposed to connect to a through hole formed on the lower surface of the case, thereby effectively discharging air in the air guide out of the case. A connecting portion having a bent shape may be formed at the end of the air guide, thereby easily connecting the end of the air guide to the through hole.

Embodiments disclosed herein provide an electric range that may include a case having a first through hole and a second through hole on a lower surface thereof; a heating unit (heater) disposed in the case and configured to heat an object to be heated; a drive circuit disposed between the first through hole and the second through hole, and configured to drive the heating unit; an air blowing fan (fan) configured to output air supplied through the first through hole; and an air guide configured to guide air output from the air blowing fan to at least a portion of the drive circuit and to discharge the air through the second through hole.

Embodiments disclosed herein provide an electric range that may include a case; a heating unit (heater) disposed in the case and configured to heat an object to be heated; a drive circuit spaced a predetermined first distance apart from a lower surface of the case and configured to drive the heating unit; an air blowing fan (fan) disposed in contact with the lower surface of the case and configured to output air; and an air guide configured to guide air output from the air blowing fan to at least a portion of the drive circuit. The air output from the air blowing fan may be supplied to one end of the air guide. A first member may be formed at the one end of the air guide. The first member may be configured to prevent the air output from the air blowing fan from flowing into a space between the lower surface of the case and the drive circuit.

Embodiments disclosed herein provide an electric range that may include a case having a first through hole and a second through hole, for example, on a lower surface thereof; a heating unit (heater) disposed in the case and configured to heat an object to be heated; a drive circuit configured to drive the heating unit and disposed between the first through hole and the second through hole; an air blowing fan (fan) disposed in the case at the first through hole to introduce air supplied through the first through hole into the case; and an air guide disposed between the air blowing fan and the second through hole and configured to guide air output from the air blowing fan to at least a portion of the drive circuit and then to the second through hole to discharge the air discharge therethrough.

Embodiments disclosed herein provide an air guide included in an electric range that may include a housing having a hollow inside, and a first member formed on a lower side of one end of the housing. An output from an air blowing fan (fan) of the electric range may be supplied to one (first) end of the housing, and air output from the air blowing fan may be discharged through the other (second) end of the housing, the other end of the housing having a curved shape. The first member may be configured to prevent the air output from the air blowing fan from flowing into a space between the lower surface of the case and the drive circuit in the case.

The drive circuit may be spaced a predetermined first distance, for example, in a vertical direction, apart from the case, for example, from a lower surface of the case. The drive circuit may be mounted on the case, for example, on a lower surface of the case. Air output from the air blowing fan may be supplied to one (first) end of the air guide. A first member may be formed at the one end of the air guide. The first member may be configured to prevent the air output from the air blowing fan from flowing into a space between the lower surface of the case and the drive circuit.

The first member may be disposed between the air blowing fan and the drive circuit. One (first) end of the first member may be disposed to contact the lower surface of the case. The other (second) end of the first member may be disposed to contact an end of the drive circuit.

The first member may have an inclined shape, for example, forming an angle with the lower surface of the case and/or with a horizontal plane. The first member may be formed at a lower end of one end of the air guide. Based on the inclined shape of the first member, air output from the air blowing fan, for example, a lower portion of the air blowing fan, may be guided to at least a portion of the drive circuit. That is, the first member may be configured to guide the air from the air blowing fan to an upper portion at least a portion of the drive circuit.

A height, for example, a vertical dimension or length, of the first member may correspond to the first distance. A middle end (or middle portion) of the air guide may be disposed to encircle or surround or cover at least a portion of the drive circuit. Both sides of the middle end of the air guide may be disposed in contact with the drive circuit, for example, with an upper surface of a board of the drive circuit. The middle end may have a U-shaped cross-section, for example, in a plane perpendicular to a connection line between the first through hole and the second through hole or perpendicular to the flow direction of air guided within the air guide.

The electric range may further include a heat sink disposed over at least a portion of the drive circuit. The heat sink may be disposed inside of the middle end of the air guide.

The other end of the air guide may be disposed in contact with or adjacent to and/or at least partially surrounding the second through hole. That is, the other end of the air guide may be disposed adjacent to the second through hole to guide air flowing within the air guide to the second through hole to flow therethrough.

The other end of the air guide may have a curved shape or cross-section, for example, in a plane perpendicular to the lower surface and parallel to a flow direction of the air flowing within the air guide. The other end of the air guide may have a shape configured to guide air flowing within the air guide to the second through hole to flow therethrough. At least a portion of the other end, for example, a lower portion of the other end, of the air guide may have a shape corresponding to a shape of the second through hole.

A first connecting portion may be formed at an end, for example, at the other end, of the air guide. The first connecting portion may protrude to an outside of the second through hole to be couple to the other end of the air guide. That is, the first connecting portion may extend from the other end of the air guide in a direction away from the second through hole and/or from the middle end of the air guide.

The first connecting portion may have an extended portion extended downward, for example, in a vertical direction, from the other end of the air guide. The first connecting portion may further have a bent portion bent at, or extending at an angle from, the extended portion. The extended portion may be disposed in contact with an edge of the second through hole. The bent portion may be disposed under or below the lower surface of the case adjacent to the second through hole. The bent portion may extend through the second through hole to an outside of the case and/or may extend in parallel to the lower surface of the case.

At least one connecting portion may be formed extending laterally from the one end of the air guide that is adjacent to the air blowing fan. A second connecting portion and/or a third connecting portion may be formed on both sides of one end of the air guide. The second and/or third connection portion may have a coupling hole to couple the air guide and the lower surface of the case.

The air guide may have an open lower side. That is, a side of the air guide facing the lower surface of the case is open. The end of the air guide adjacent to the air blowing fan may have an opening extending in a vertical plane. The end of the air guide adjacent to the second through hole may have an opening extending in a horizontal plane.

The electric range may be an electric resistance-type electric range or an induction heating-type electric range. Directional indication, such as height, heightwise or vertical direction, width, upper end, and lower end, for example, may refer to an orientation when the electric range is in its operative state or position. In particular, a heightwise direction may also be referred to as vertical direction. Width may denote a dimension in the horizontal direction, in particular in a horizontal direction parallel to a (vertical) front surface of the case of the electric range which will be facing a user during operation. Thus, left end and right end may denote respectively a first lateral end and a second lateral end with respect to an operative state or position of the electric range. Likewise a front end may denote an end that is closer to a user when operating the electric range, while a rear end may denote an end that is farther from a user when operating the electric range.

According embodiments disclosed herein, air output from an air bowing fan may be prevented from escaping out of an air guide. Air output from the air blowing fan may be delivered to an object to be cooled in a concentrated manner.

According to embodiments disclosed herein, cooling efficiency of a heat sink may improve, and manufacturing costs of the air guide may be reduced. Further, the air guide may be readily assembled. As air output from the air blowing fan may flow from a front end to a rear end, a user may touch an input interface without causing any inconvenience to the user.

Embodiments are described above with reference to a number of illustrative embodiments thereof. However, the embodiments are not intended to limit the embodiments and drawings set forth herein, and numerous other modifications and embodiments can be devised by one skilled in the art without departing from the technical idea. Further, the effects and predictable effects based on configurations are to be included within the range though not explicitly described in the description of embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric range, comprising:

a case having at least one first through hole and at least one second through hole;

at least one heating unit disposed in the case, and configured to heat an object to be heated;

a drive circuit configured to drive the at least one heating unit and disposed between the at least one first through hole and the at least one second through hole;

at least one air blowing fan disposed in the case at the at least one first through hole to introduce air through the at least one first through hole into the case; and at least one air guide disposed between the at least one air blowing fan and the at least one second through hole and configured to guide air from the at least one air blowing fan to the drive circuit and then to the at least one second through hole to discharge the air therethrough, wherein the drive circuit is spaced apart from a lower surface of the case by a predetermined first distance, wherein a first end of the at least one air guide is disposed adjacent to the at least one air blowing fan, wherein the first end of the at least one air guide includes a first member having an inclined shape configured to guide air output from the at least one air blowing fan to an upper portion of the drive circuit, wherein the first member is formed at a lower end of the one end of the at least one air guide, wherein the case has a boss that protrudes upward from the lower surface of the case, and wherein a first end of the first member is disposed to contact the lower surface of the case, and a second end of the first member is disposed to contact an end of the drive circuit disposed on the boss.

2. The electric range according to claim 1, wherein a height of the first member corresponds to the predetermined first distance between the lower surface of the case and the drive circuit.

3. The electric range of claim 1, wherein the at least one air guide includes a middle portion that covers at least a portion of the drive circuit.

4. The electric range of claim 3, wherein the middle portion of the air guide has a U-shaped cross-section and both sides of the middle portion are disposed in contact with the drive circuit.

5. The electric range of claim 3, further comprising:

a heat sink disposed over at least a portion of the drive circuit, wherein the heat sink is disposed inside of the middle portion of the at least one air guide.

6. The electric range of claim 1, wherein a second end of the at least one air guide is disposed at least one of adjacent to or at least partially surrounding the at least one second through hole.

7. The electric range of claim 6, wherein the second end of the at least one air guide adjacent to the at least one second through hole has a curved shape.

8. The electric range of claim 6, wherein a first connecting portion is formed at the second end the at least one air guide adjacent to the at least one second through hole, and wherein the first connecting portion passes through the at least one second through hole to couple the second end of the at least one air guide to the case.

9. The electric range of claim 8, wherein the first connecting portion has an extended portion that extends through the at least one second through hole and a bent portion that extends at an angle from the extended portion in parallel to an outside of the lower surface of the case.

10. The electric range of claim 1, wherein at least one connecting portion is formed that extends laterally from the first end of the at least one air guide disposed adjacent to the at least one air blowing fan, and wherein the connection portion has a coupling hole to couple the at least one air guide to the case.

11. The electric range of claim 1, wherein the at least one air guide has an open lower side.

12. The electric range of claim 1, wherein the first end of the at least one air guide disposed adjacent to the at least one air blowing fan has an opening that extends in a vertical plane.

13. The electric range of claim 12, wherein a second end of the at least one air guide adjacent to the at least one second through hole has an opening that extends in a horizontal plane.

14. An air guide for an electric range, comprising:

a housing having a hollow inside; and a first member formed on a lower side of a first end of the housing, wherein the first end of the housing is configured to receive air output from an air blowing fan of the electric range and a second end of the housing is configured to discharge air output from the air blowing fan, wherein the second end of the housing has a curved shape, wherein the first member is configured to prevent air output from the air blowing fan from flowing into a space between a lower surface of a case of the electric range and a drive circuit in the case of the electric range, wherein the first member has an inclined shape, wherein the first member is formed at a lower end of the one end of the housing, wherein the case has a boss that protrudes upward from the lower surface of the case, and wherein a first end of the first member is disposed to contact the lower surface of the case, and a second end of the first member is disposed to contact an end of the drive circuit disposed on the boss.

15. An electric range comprising the air guide of claim 14.

16. An electric range, comprising:

a case having at least one first through hole and at least one second through hole;

at least one working coil disposed in the case, and configured to heat an object to be heated;

a drive circuit configured to drive the at least one working coil and disposed between the at least one first through hole and the at least one second through hole;

at least one fan disposed in the case adjacent the at least one first through hole to introduce air through the at least one first through hole into the case; and at least one air guide disposed between the at least one fan and the at least one second through hole and configured to guide air from the at least one fan to the drive circuit and then to the at least one second through hole to discharge the air therethrough, wherein the drive circuit is spaced apart from a lower surface of the case by a predetermined first distance, wherein a first end of the at least one air guide includes an inclined surface configured to guide air output from the at least one fan to an upper portion of the drive circuit and prevent the air output from the at least one fan from flowing into a space between the lower surface of the case and the drive circuit, wherein the first member is formed at a lower end of the one end of the at least one air guide, wherein the case has a boss that protrudes upward from the lower surface of the case, and wherein a first end of the inclined surface is disposed to contact the lower surface of the case, and a second end of the inclined surface is disposed to contact an end of the drive circuit disposed on the boss.

* * * * *